US011255586B2

(12) United States Patent
Wan et al.

(10) Patent No.: US 11,255,586 B2
(45) Date of Patent: Feb. 22, 2022

(54) PARALLEL-CONNECTED CONDENSATION DEVICE

(71) Applicant: Man Zai Industrial Co., LTD., Tainan (TW)

(72) Inventors: Cheng-Chien Wan, Tainan (TW); Cheng-Jui Wan, Tainan (TW); Chun-Hsien Su, Tainan (TW); Hui-Fen Huang, Tainan (TW)

(73) Assignee: MAN ZAI INDUSTRIAL CO., LTD., Tainan (TW)

( * ) Notice: Subject to any disclaimer, the term of this patent is extended or adjusted under 35 U.S.C. 154(b) by 137 days.

(21) Appl. No.: 16/369,955

(22) Filed: Mar. 29, 2019

(65) Prior Publication Data

US 2020/0224942 A1 Jul. 16, 2020

(30) Foreign Application Priority Data

Jan. 16, 2019 (TW) ..... 108101687

(51) Int. Cl.

| | |
|---|---|
| ***F28D 1/04*** | (2006.01) |
| ***F25B 39/04*** | (2006.01) |
| ***F28D 1/02*** | (2006.01) |
| ***F28F 1/14*** | (2006.01) |
| ***F28D 1/053*** | (2006.01) |
| ***F28F 1/24*** | (2006.01) |

(52) U.S. Cl.

CPC ..... *F25B 39/04* (2013.01); *F28D 1/0233* (2013.01); *F28D 1/0246* (2013.01); *F28D 1/05316* (2013.01); *F28F 1/14* (2013.01); *F28F 1/24* (2013.01)

(58) Field of Classification Search

CPC ..... F25B 39/04; F28D 1/0233; F28D 1/0246; F28D 1/0435; F28D 1/05341; F28D 1/05316; F28F 1/14; F28F 1/24; F28F 1/128; F28F 1/022; F28F 2215/02; F28F 2215/08; F28F 2225/04

See application file for complete search history.

(56) References Cited

U.S. PATENT DOCUMENTS 3,990,504 A * 11/1976 Kolthoff, Jr. ..... F28D 1/05341 165/271
4,098,328 A * 7/1978 Cheong ..... F28F 9/0231 123/41.54
5,000,257 A * 3/1991 Shinmura ..... F28D 1/0435 165/140
5,086,835 A * 2/1992 Shinmura ..... F28D 1/0435 123/41.51
5,176,200 A * 1/1993 Shinmura ..... F28D 1/0435 165/144

(Continued)

*Primary Examiner* — Travis Ruby

(74) *Attorney, Agent, or Firm* — Muncy, Geissler, Olds & Lowe, P.C.

(57) ABSTRACT

The present invention provides a parallel-connected condensation device, comprising a front condensation unit, a rear condensation unit, and a plurality of heat dissipation fins. The front condensation unit is parallel to the rear condensation unit. The heat dissipation fins is inserted into the front condensation unit and the rear condensation unit. The front condensation unit and the rear condensation unit comprise a plurality of confluence chambers. The confluence chambers are connected with each other to form a plurality of flow channels.

5 Claims, 15 Drawing Sheets

(56) References Cited

U.S. PATENT DOCUMENTS

| | | | | |
|---|---|---|---|---|
| 5,529,116 | A * | 6/1996 | Sasaki | F28D 1/0417 123/41.51 |
| 5,582,239 | A * | 12/1996 | Tsunoda | B21D 53/02 165/176 |
| 5,622,219 | A * | 4/1997 | Voss | F25B 39/02 165/144 |
| 6,209,628 | B1 * | 4/2001 | Sugimoto | F28D 1/0435 165/135 |
| 7,073,570 | B2 * | 7/2006 | Yu | F28D 1/0443 165/140 |
| 2001/0022220 | A1 * | 9/2001 | Ozaki | F28F 1/126 165/135 |
| 2001/0035284 | A1 * | 11/2001 | Iwasaki | F28F 1/128 165/135 |
| 2007/0199685 | A1 * | 8/2007 | Hu | F28D 1/0435 165/140 |
| 2008/0078537 | A1 * | 4/2008 | Desai | F28D 1/0435 165/140 |
| 2010/0147498 | A1 * | 6/2010 | Huang | F28D 1/05383 165/151 |
| 2012/0180989 | A1 * | 7/2012 | Ota | B60H 1/00328 165/104.13 |
| 2015/0053376 | A1 * | 2/2015 | Matsumoto | B60H 1/00328 165/144 |
| 2016/0003545 | A1 * | 1/2016 | Taras | F28F 9/0214 165/143 |
| 2016/0138871 | A1 * | 5/2016 | Matsumoto | F28F 9/262 165/143 |
| 2016/0341488 | A1 * | 11/2016 | Wan | H01L 23/427 |
| 2018/0216892 | A1 * | 8/2018 | Kaneko | F28F 1/025 |
| 2019/0078846 | A1 * | 3/2019 | Wan | F28D 1/0435 |
| 2020/0064074 | A1 * | 2/2020 | Wan | F28D 15/0266 |

* cited by examiner

PARALLEL-CONNECTED CONDENSATION DEVICE

BACKGROUND OF THE INVENTION

1. Technical Field

The present invention relates to a condensation device and more particularly to a parallel-connected condensation device configured to improve heat dissipation effectively.

2. Description of Related Art

With continuous technological advancement, electronic products have been improved incessantly in order to have more functions, deliver better performances, and achieve higher efficiency. As is well known in the art, an electronic product generates a considerable amount of heat during operation and, if the heat is not dissipated but accumulates, may eventually slow down or even stop functioning due to overheating. The resulting high temperature may also damage the electronic components, and thus shorten the service life, of the electronic product. It is therefore common practice to provide an electronic product with a heat dissipation device at a position where the most heat is generated, in order for the heat dissipation device to dissipate heat through thermal conduction or convection and thereby cool down the electronic product rapidly, ensuring that the electronic product will operate stably as intended.

A conventional heat dissipation device typically includes an evaporator, a condenser, a plurality of refrigerant tubes, and a closed circuit formed between the evaporator, the condenser, and the refrigerant tubes. The circuit is filled with a refrigerant and serves as a circulating heat dissipation mechanism that makes use of the physical change, or more particularly the transition between liquid and gaseous states, of the refrigerant while the refrigerant absorbs or releases heat. To accelerate heat exchange, one intuitive approach is to increase the area of contact between the condenser and airflow and the total length of the heat dissipation tubes of the condenser, the objective being to expose the refrigerant to, and thus vaporize the refrigerant by, as much heat as possible in one circulation cycle. However, if the area of contact of the condenser is increased by widening the condenser in a direction perpendicular to the airflow, as is intuitively obvious, the condenser will take up too much space. Furthermore, while an increase in the area of contact enhances the overall heat exchange rate, the speed at which temperature falls may remain unchanged or even lower as the airflow increases.

In view of the foregoing deficiencies of the conventional condenser, the inventor of the present invention thought it necessary to devise a condenser that is effective in increasing heat dissipation efficiency.

BRIEF SUMMARY OF THE INVENTION

The primary objective of the present invention is to provide a condensation device configured to improve heat dissipation effectively.

In order to achieve the above objective, the present invention provides a parallel-connected condensation device, comprising a front condensation unit, a rear condensation unit, and a plurality of heat dissipation fins. The front condensation unit comprises a front left flow tube, a front right flow tube, and a plurality of front heat dissipation tubes in communication with the front left flow tube and the front right flow tube, wherein the front left flow tube and the front right flow tube are provided on two opposite lateral sides of the front condensation unit respectively. The front heat dissipation tubes are vertically spaced apart. The front left flow tube includes a first confluence chamber, and the front right flow tube includes a second confluence chamber. The rear condensation unit is parallel to the front condensation unit and comprises a rear left flow tube, a rear right flow tube, and a plurality of rear heat dissipation tubes in communication with the rear left flow tube and the rear right flow tube, wherein the rear left flow tube and the rear right flow tube are provided on two opposite lateral sides of the rear condensation unit respectively. The rear heat dissipation tubes are vertically spaced apart. Gaps between the rear heat dissipation tubes and gaps between the front heat dissipation tubes correspond to each other and jointly form a plurality of through grooves. The rear left flow tube includes a third confluence chamber, and the rear right flow tube includes a fourth confluence chamber. A plurality of heat dissipation fins are inserted in the through grooves respectively and thereby extend through the front condensation unit and the rear condensation unit, wherein the heat dissipation fins are in contact with surfaces of the front heat dissipation tubes and surfaces of the rear heat dissipation tubes to enable heat exchange between the heat dissipation fins and the heat dissipation tubes. At least one left opening is provided between the front left flow tube and the rear left flow tube to enable communication between the first confluence chamber and the third confluence chamber. At least one right opening is provided between the front right flow tube and the rear right flow tube to enable communication between the second confluence chamber and the fourth confluence chamber. The first confluence chamber of the front left flow tube communicates with the second confluence chamber of the front right flow tube through the front heat dissipation tubes to form a first flow channel, and the third confluence chamber of the rear left flow tube communicates with the fourth confluence chamber of the rear right flow tube through the rear heat dissipation tubes to form a second flow channel. The second flow channel is connected in parallel to the first flow channel.

Furthermore, the present invention provides a parallel-connected condensation device, comprising a front condensation unit, a rear condensation unit, and a plurality of heat dissipation fins. The front condensation unit comprises a front left flow tube, a front right flow tube, and a plurality of front heat dissipation tubes in communication with the front left flow tube and the front right flow tube, wherein the front left flow tube and the front right flow tube are provided on two opposite lateral sides of the front condensation unit respectively. The front heat dissipation tubes are vertically spaced apart. The front left flow tube includes a first confluence chamber and a second confluence chamber below the first confluence chamber, and the front right flow tube includes a third confluence chamber. The rear condensation unit is parallel to the front condensation unit and comprises a rear left flow tube, a rear right flow tube, and a plurality of rear heat dissipation tubes in communication with the rear left flow tube and the rear right flow tube, wherein the rear left flow tube and the rear right flow tube are provided on two opposite lateral sides of the rear condensation unit respectively. The rear heat dissipation tubes are vertically spaced apart. Gaps between the rear heat dissipation tubes and gaps between the front heat dissipation tubes correspond to each other and jointly form a plurality of through grooves. The rear left flow tube includes a fourth confluence chamber and a fifth confluence chamber below the fourth confluence chamber, and the rear right flow tube includes a sixth confluence chamber. A plurality of heat dissipation fins are inserted in the through grooves respectively and thereby extend through the front condensation unit and the rear condensation unit, wherein the heat dissipation fins are in contact with surfaces of the front heat dissipation tubes and surfaces of the rear heat dissipation tubes to enable heat exchange between the heat dissipation fins and the heat dissipation tubes. An upper opening is provided between the front left flow tube and the rear left flow tube to enable communication between the first confluence chamber and the fourth confluence chamber. A lower opening is provided between the front left flow tube and the rear left flow tube to enable communication between the second confluence chamber and the fifth confluence chamber. The first confluence chamber of the front left flow tube communicates with the third confluence chamber of the front right flow tube through corresponding upper ones of the front heat dissipation tubes to form a first flow channel. The third confluence chamber of the front right flow tube communicates with the second confluence chamber of the front left flow tube through corresponding lower ones of the front heat dissipation tubes to form a second flow channel. The second flow channel lies below the first flow channel and has a flow direction opposite to the flow direction of the first flow channel. The first confluence chamber of the front left flow tube communicates with the fourth confluence chamber of the rear left flow tube through the upper opening to form a third flow channel. The fourth confluence chamber of the rear left flow tube communicates with the sixth confluence chamber of the rear right flow tube through corresponding upper ones of the rear heat dissipation tubes to form a fourth flow channel. The fourth flow channel is connected in parallel to and has a same flow direction as the first flow channel. The sixth confluence chamber of the rear right flow tube communicates with the fifth confluence chamber of the rear left flow tube through corresponding lower ones of the rear heat dissipation tubes to form a fifth flow channel. The fifth flow channel is connected in parallel to and has a same flow direction as the second flow channel. The fifth confluence chamber of the rear left flow tube communicates with the second confluence chamber of the front left flow tube through the lower opening to form a sixth flow channel. The sixth flow channel lies below the third flow channel and has a flow direction opposite to the flow direction of the third flow channel.

Furthermore, the present invention provides a parallel-connected condensation device, comprising a front condensation unit, a rear condensation unit, and a plurality of heat dissipation fins. The front condensation unit comprises a front left flow tube, a front right flow tube, and a plurality of front heat dissipation tubes in communication with the front left flow tube and the front right flow tube, wherein the front left flow tube and the front right flow tube are provided on two opposite lateral sides of the front condensation unit respectively. The front heat dissipation tubes are vertically spaced apart. The front left flow tube includes a first confluence chamber and a second confluence chamber below the first confluence chamber, and the front right flow tube includes a third confluence chamber and a fourth confluence chamber below the third confluence chamber. The rear condensation unit is parallel to the front condensation unit and comprises a rear left flow tube, a rear right flow tube, and a plurality of rear heat dissipation tubes in communication with the rear left flow tube and the rear right flow tube, wherein the rear left flow tube and the rear right flow tube are provided on two opposite lateral sides of the rear condensation unit respectively. The rear heat dissipation tubes are vertically spaced apart. Gaps between the rear heat dissipation tubes and gaps between the front heat dissipation tubes correspond to each other and jointly form a plurality of through grooves. The rear left flow tube includes a fifth confluence chamber, and the rear right flow tube includes a sixth confluence chamber and a seventh confluence chamber below the sixth confluence chamber. A plurality of heat dissipation fins are inserted in the through grooves respectively and thereby extend through the front condensation unit and the rear condensation unit, wherein the heat dissipation fins are in contact with surfaces of the front heat dissipation tubes and surfaces of the rear heat dissipation tubes to enable heat exchange between the heat dissipation fins and the heat dissipation tubes. An upper opening is provided between the front right flow tube and the rear right flow tube to enable communication between the third confluence chamber and the sixth confluence chamber. A lower opening is provided between the front right flow tube and the rear right flow tube to enable communication between the fourth confluence chamber and the seventh confluence chamber. The first confluence chamber of the front left flow tube communicates with the third confluence chamber of the front right flow tube through corresponding upper ones of the front heat dissipation tubes to form a first flow channel. The third confluence chamber of the front right flow tube communicates with the sixth confluence chamber of the rear right flow tube through the upper opening to form a second flow channel. The sixth confluence chamber of the rear right flow tube communicates with the fifth confluence chamber of the rear left flow tube through corresponding upper ones of the rear heat dissipation tubes to form a third flow channel. The third flow channel is connected in parallel to the first flow channel and has a flow direction opposite to the flow direction of the first flow channel. The fifth confluence chamber of the rear left flow tube communicates with the seventh confluence chamber of the rear right flow tube through corresponding lower ones of the rear heat dissipation tubes to form a fourth flow channel. The fourth flow channel is connected in parallel to and has a same flow direction as the first flow channel. The seventh confluence chamber of the rear right flow tube communicates with the fourth confluence chamber of the front right flow tube through the lower opening to form a fifth flow channel. The fifth flow channel lies below the second flow channel and has a flow direction opposite to the flow direction of the second flow channel. The fourth confluence chamber of the front right flow tube communicates with the second confluence chamber of the front left flow tube through corresponding lower ones of the front heat dissipation tubes to form a sixth flow channel. The sixth flow channel is connected in parallel to the fourth flow channel and has a flow direction opposite to the flow direction of the fourth flow channel.

Comparing to the conventional techniques, the present invention has the following advantages:

1. According to the present invention, heat exchange through a refrigerant is facilitated by connecting a front condensation unit and a rear condensation unit in parallel, by providing a refrigerant inlet and a refrigerant outlet on two lateral sides respectively or on the same side, and by forming a plurality of flow channels that are in communication with one another.

2. According to the present invention, a plurality of heat dissipation fins extend through both the front condensation unit and the rear condensation unit to reduce the difference in heat dissipation efficiency between the condensation units, thereby providing effective improvement in cooling.

DETAILED DESCRIPTION OF THE INVENTION

The details and technical solution of the present invention are hereunder described with reference to accompanying drawings. For illustrative sake, the accompanying drawings are not drawn to scale. The accompanying drawings and the scale thereof are not restrictive of the present invention.

Figure 1:
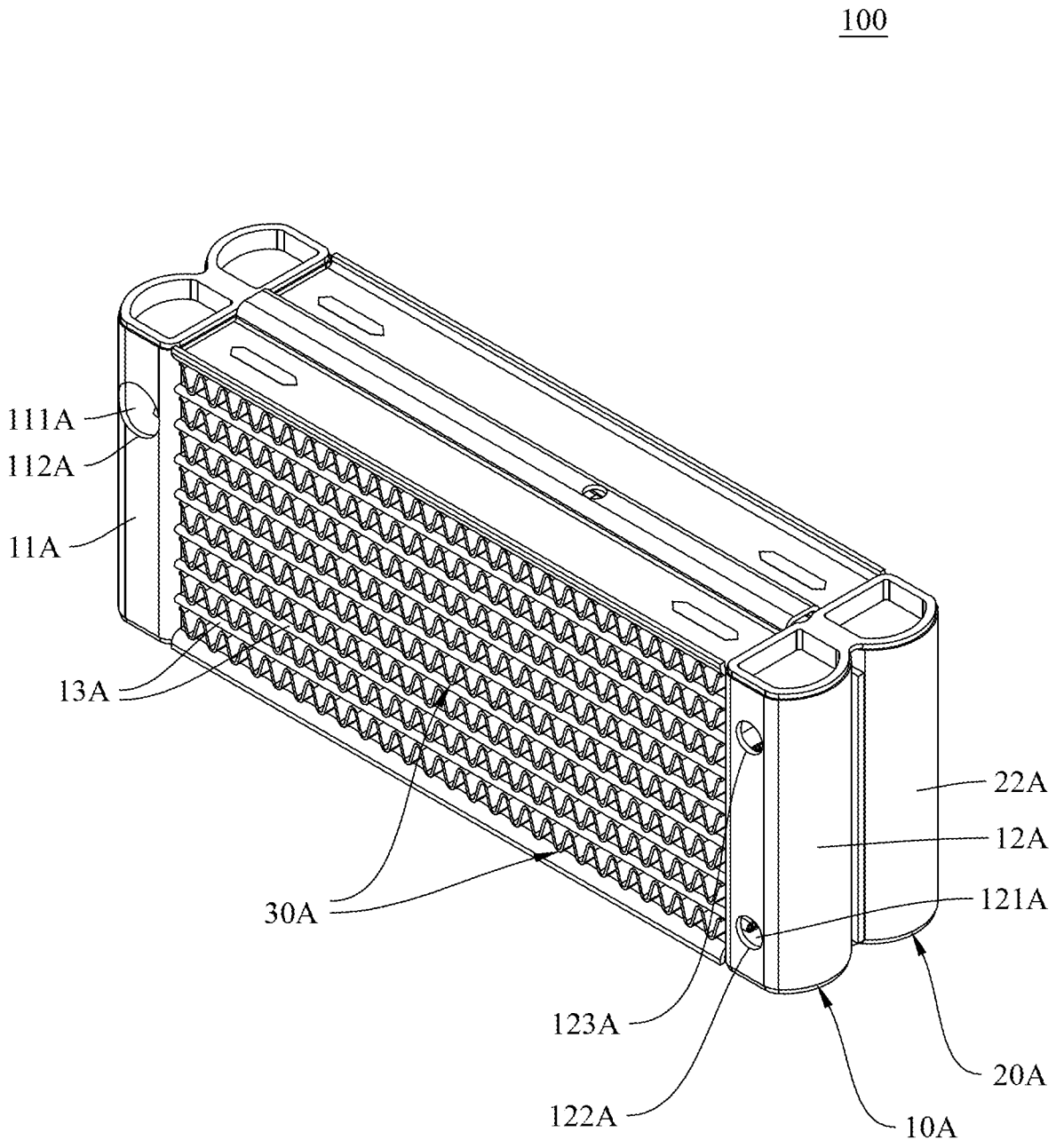
FIG. 1 is a perspective view of the parallel-connected condensation device according to the first embodiment of the present invention.

Please refer to FIG. 1 for a perspective view of the parallel-connected condensation device according to the first embodiment of the present invention.

The first embodiment discloses a parallel-connected condensation device 100 for use mainly in the fields of optics, communications, data processing, servers, and so on where high-heat laminated circuits are typically required. The present invention can be applied to such electronic products as servers, data displays, remote radio units (RRUs) for communication purposes, artificial intelligence (AI) devices, display chips, and laser chips to provide a cooling/heat dissipation effect through conduction-, convection-, or material-based heat exchange. The invention is intended for the condenser of an electronic product and involves heat exchange via a refrigerant that flows through tubes and channels to rapidly remove the heat accumulating in the electronic product, lest the electronic components of the electronic product be damaged, or the operation efficiency of the electronic product be lowered, by prolonged exposure to a high-temperature environment.

The structural details of the parallel-connected condensation device of the present invention will be described below with reference to a number of embodiments. To start with, please refer to FIG. 2 and FIG. 3 for sectional views respectively of the front condensation unit and the rear condensation unit of the parallel-connected condensation device according to the first embodiment of the present invention.

As shown in the drawings, the parallel-connected condensation device 100 includes a front condensation unit 10A, a rear condensation unit 20A, and a plurality of heat dissipation fins 30A.

The front condensation unit 10A includes a front left flow tube 11A, a front right flow tube 12A (these two flow tubes being provided on the two opposite lateral sides of the front condensation unit 10A respectively), and a plurality of front heat dissipation tubes 13A that communicate with the front left flow tube 11A and the front right flow tube 12A. The front heat dissipation tubes 13A are vertically spaced apart. The front left flow tube 11A includes a first confluence chamber 111A, and the front right flow tube 12A includes a second confluence chamber 121A.

The rear condensation unit 20A is parallel to the front condensation unit 10A and includes a rear left flow tube 21A, a rear right flow tube 22A (these two flow tubes being provided on the two opposite lateral sides of the rear condensation unit 20A respectively), and a plurality of rear heat dissipation tubes 23A that communicate with the rear left flow tube 21A and the rear right flow tube 22A. The rear heat dissipation tubes 23A are vertically spaced apart. The gaps between the rear heat dissipation tubes 23A and those between the front heat dissipation tubes 13A correspond to each other and jointly form a plurality of through grooves HA. The rear left flow tube 21A includes a third confluence chamber 211A, and the rear right flow tube 22A includes a fourth confluence chamber 221A.

Figure 2:
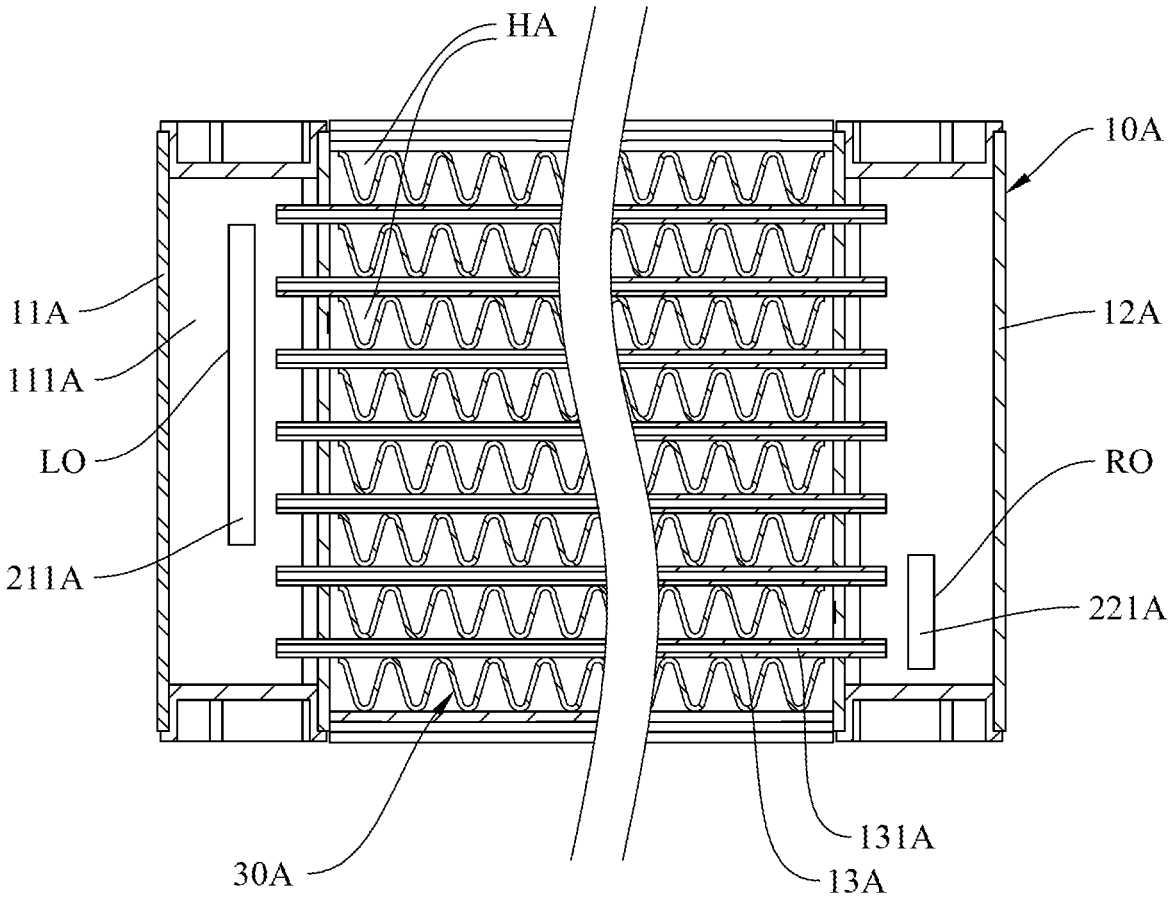
FIG. 2 is a sectional view of the front condensation unit of the parallel-connected condensation device according to the first embodiment of the present invention.
Figure 3:
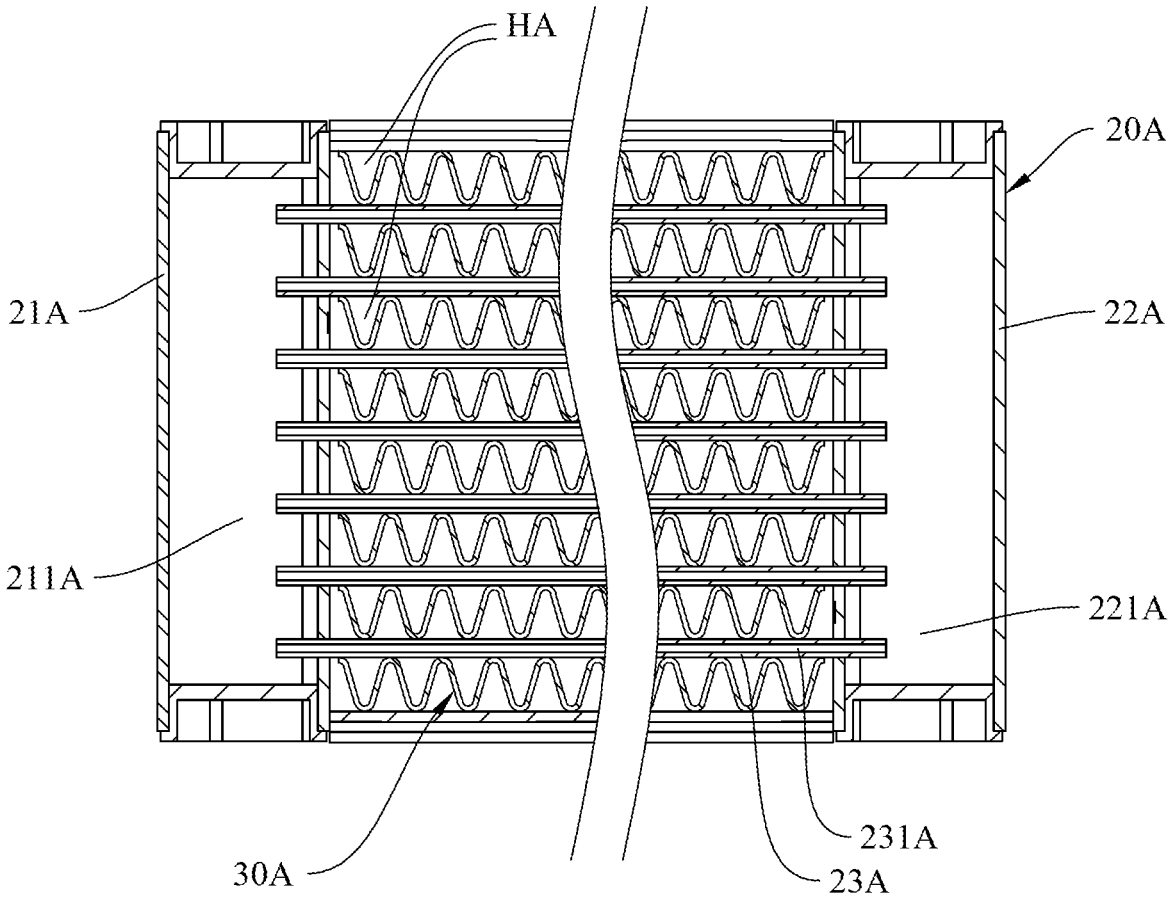
FIG. 3 is a sectional view of the rear condensation unit of the parallel-connected condensation device according to the first embodiment of the present invention.

At least one left opening LO is provided between the front left flow tube 11A and the rear left flow tube 21A to enable communication between the first confluence chamber 111A and the third confluence chamber 211A. At least one right opening RO is provided between the front right flow tube 12A and the rear right flow tube 22A to enable communication between the second confluence chamber 121A and the fourth confluence chamber 221A. As shown in FIG. 2, there is one left opening LO and one right opening RO, and the two openings are rectangular and are diagonally arranged with respect to each other, wherein the bottom side of the left opening LO is higher than the top side of the right opening RO. The area of the left opening LO is larger than that of the right opening RO to enable rapid refrigerant input and slow refrigerant output. It should be pointed out, however, that the openings described above serve only as an example; the present invention imposes no limitation on the number or shapes of those openings.

The front left flow tube 11A is provided with a refrigerant inlet 112A in communication with the first confluence chamber 111A so that a refrigerant can be delivered through the refrigerant inlet 112A into the first confluence chamber 111A. The refrigerant inlet 112A overlaps the left opening LO by an area less than 45% of the area of the refrigerant inlet 112A. The front right flow tube 12A is provided with a refrigerant outlet 122A in communication with the second confluence chamber 121A so that the refrigerant in the second confluence chamber 121A can be output through the refrigerant outlet 122A. In a preferred embodiment, an inlet/outlet 123A is additionally provided in a top portion of the front right flow tube 122A to serve as either an input end or an output end.

Figure 4:
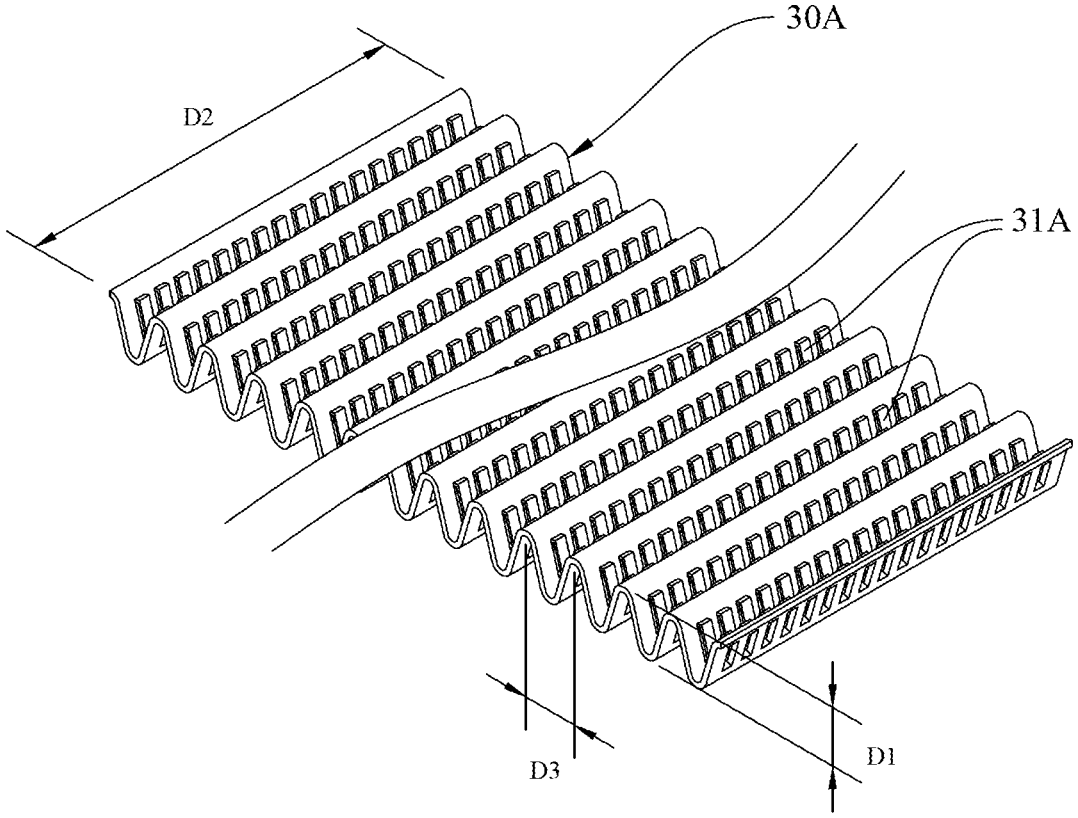
FIG. 4 is a perspective view of a heat dissipation fin of the parallel-connected condensation device of the present invention.

Please refer to FIG. 4 for a perspective view of a heat dissipation fin of the parallel-connected condensation device of the present invention.

The heat dissipation fins 30A are inserted in the through grooves HA respectively, extending through the front condensation unit 10A and the rear condensation unit 20A. The heat dissipation fins 30A are in contact with the surfaces of the front heat dissipation tubes 13A and of the rear heat dissipation tubes 23A so that heat exchange can take place between the heat dissipation fins 30A and the heat dissipation tubes 13A and 23A. The heat dissipation fins 30A may have a corrugated configuration, a serrated configuration, or any other configuration achievable by bending a metal plate. Each heat dissipation fin 30A has a height D1 ranging from 4 mm to 8 mm and a length D2 ranging from 12 mm to 60 mm. The distance D3 between each two adjacent bends of each heat dissipation fin 30A ranges from 2 mm to 4 mm. There are a plurality of microstructures 31A on the surface of each heat dissipation fin 30A. The microstructures 31A may extend outward or inward with respect to the heat dissipation fins 30A to increase the area of contact between each heat dissipation fin 30A and air, thereby increasing heat dissipation efficiency.

Figure 5:
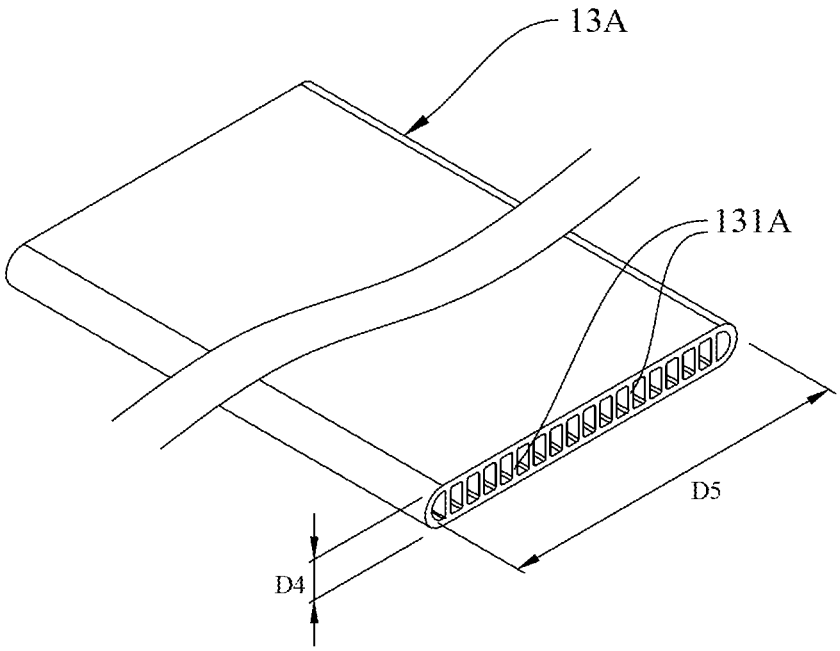
FIG. 5 is a perspective view of a front heat dissipation tube of the parallel-connected condensation device of the present invention.
Figure 6:
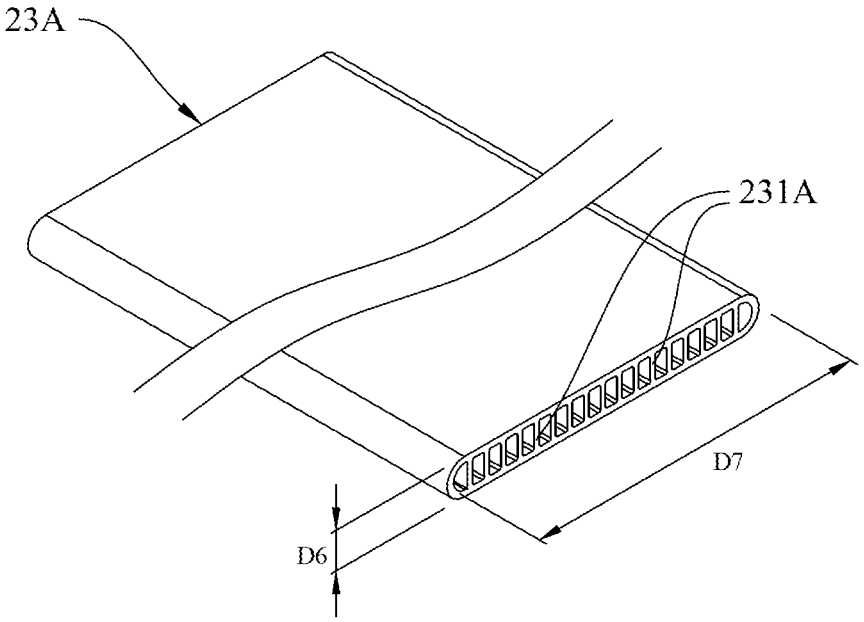
FIG. 6 is a perspective view of a rear heat dissipation tube of the parallel-connected condensation device of the present invention.

Please refer to FIG. 5 and FIG. 6 for perspective views respectively of a front heat dissipation tube and a rear heat dissipation tube of the parallel-connected condensation device of the present invention.

As shown in FIG. 5, the front heat dissipation tube 13A has a flattened configuration. The two ends of the front heat dissipation tube 13A are inserted in the front left flow tube 11A and the front right flow tube 12A respectively to connect the two flow tubes together. The front heat dissipation tube 13A has a height D4 ranging from 1 mm to 2 mm to facilitate passage of, and allow sufficient heat absorption by, a refrigerant. The front heat dissipation tube 13A has a width D5 ranging from 12 mm to 40 mm so as to provide a relatively large heat dissipation area that enhances contact, and hence heat exchange, with air and the adjacent heat dissipation fins 30A. The front heat dissipation tube 13A is provided therein with a plurality of supporting ribs 131A, which extend through the front heat dissipation tube 13A. The number of the supporting ribs 131A may range from the value of one half of the width (in millimeter) of the front heat dissipation tube 13A to the value of the full width (in millimeter) of the front heat dissipation tube 13A. For example, when the width of the front heat dissipation tube 13A is 12 mm, there may be 6 to 12 supporting ribs 131A for reinforcing, and thereby preventing deformation of, the front heat dissipation tube 13A.

As shown in FIG. 6, the rear heat dissipation tube 23A has a flattened configuration. The two ends of the rear heat dissipation tube 23A are inserted in the rear left flow tube 21A and the rear right flow tube 22A respectively to connect the two flow tubes together. The rear heat dissipation tube 23A has a height D6 ranging from 1 mm to 2 mm to facilitate passage of, and allow sufficient heat absorption by, a refrigerant. The rear heat dissipation tube 23A has a width D7 ranging from 12 mm to 40 mm so as to provide a relatively large heat dissipation area that enhances contact, and hence heat exchange, with air and the adjacent heat dissipation fins 30A. The rear heat dissipation tube 23A is provided therein with a plurality of supporting ribs 231A, which extend through the rear heat dissipation tube 23A. The number of the supporting ribs 231A may range from the value of one half of the width (in millimeter) of the rear heat dissipation tube 23A to the value of the full width (in millimeter) of the rear heat dissipation tube 23A. For example, when the width of the rear heat dissipation tube 23A is 12 mm, there may be 6 to 12 supporting ribs 231A for reinforcing, and thereby preventing deformation of, the rear heat dissipation tube 23A.

Figure 7:
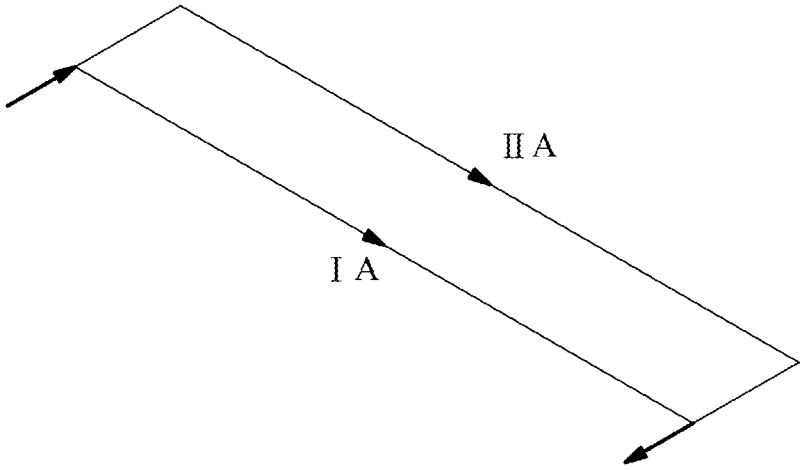
FIG. 7 is the refrigerant circulation diagram of the parallel-connected condensation device according to the first embodiment of the present invention.

Please refer now to FIG. 7 for the refrigerant circulation diagram of the parallel-connected condensation device according to the first embodiment of the present invention.

To begin with, a refrigerant is input through the refrigerant inlet 112A into the first confluence chamber 111A of the front left flow tube 11A. The first confluence chamber 111A communicates with the second confluence chamber 121A of the front right flow tube 12A through the front heat dissipation tubes 13A to form a first flow channel I A. The third confluence chamber 211A of the rear left flow tube 21A communicates with the fourth confluence chamber 221A of the rear right flow tube 22A through the rear heat dissipation tubes 23A to form a second flow channel II A, which is connected to the first flow channel I A in parallel. The refrigerant in the first flow channel I A and the refrigerant in the second flow channel II A eventually come together and exit by the refrigerant outlet 122A.

Disclosed below is the parallel-connected condensation device according to the second embodiment of the present invention. Please refer to FIG. 8 for a perspective view of the parallel-connected condensation device according to the second embodiment of the present invention.

Figure 8:
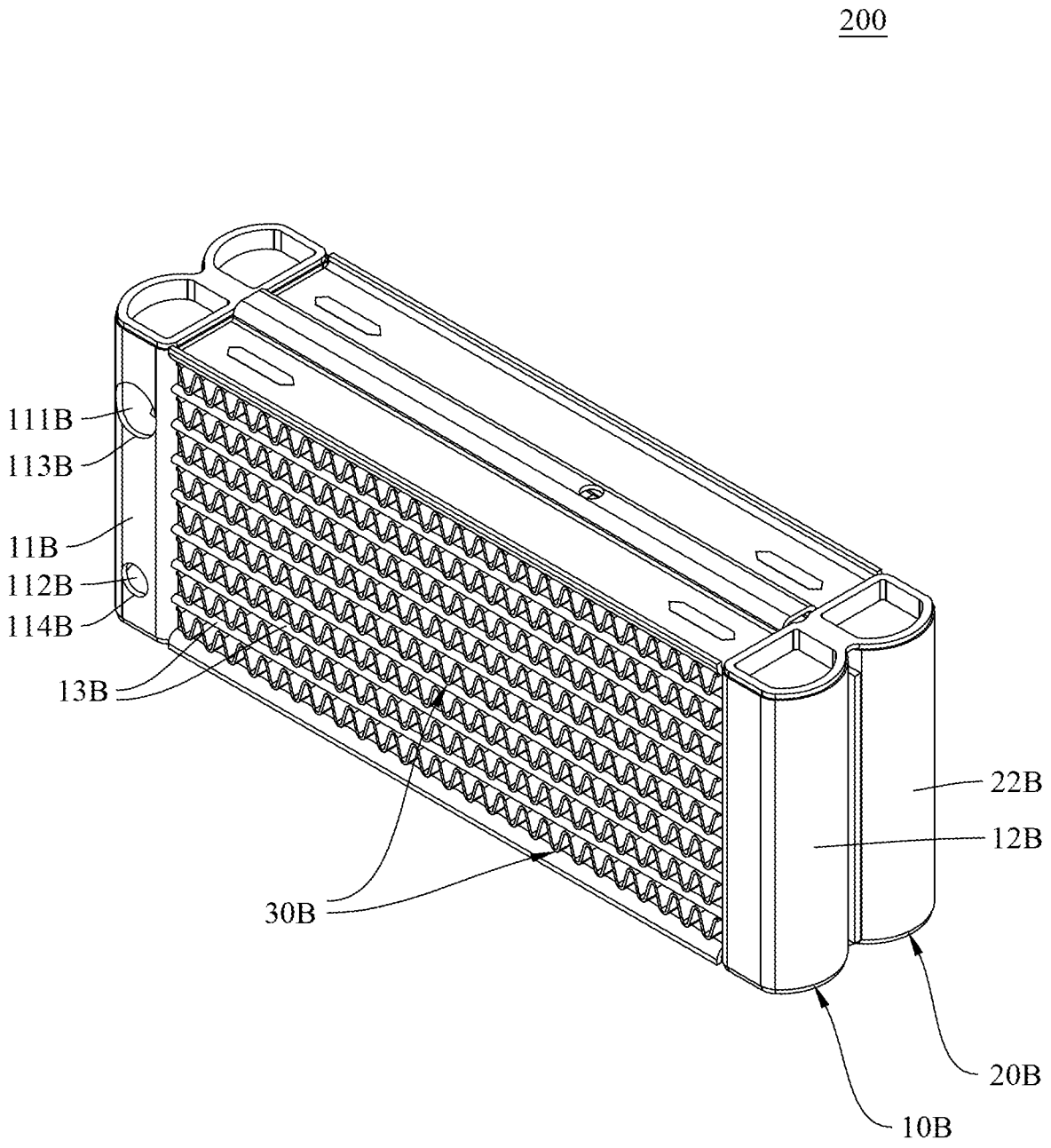
FIG. 8 is a perspective view of the parallel-connected condensation device according to the second embodiment of the present invention.

As shown in FIG. 8, the parallel-connected condensation device 200 includes a front condensation unit 10B, a rear condensation unit 20B, and a plurality of heat dissipation fins 30B, which extend through the front condensation unit 10B and the rear condensation unit 20B to enable heat exchange with both condensation units 10B and 20B. This embodiment is different from the first embodiment mainly in that partition plates are provided to separate the confluence chambers in certain flow tubes. Meanwhile, the heat dissipation fins, the front heat dissipation tubes, and the rear heat dissipation tubes in this embodiment are the same as those in the first embodiment and therefore will not be described repeatedly.

Figure 9:
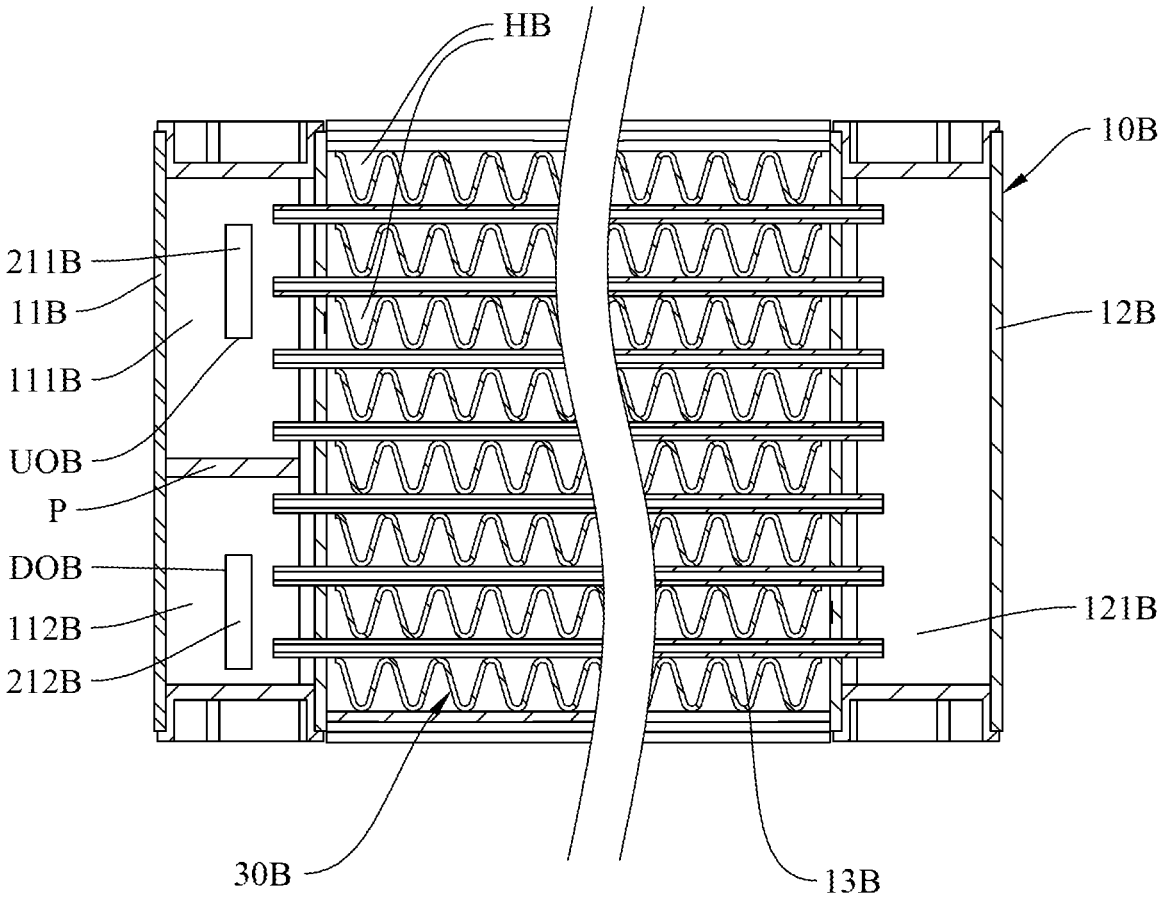
FIG. 9 is a sectional view of the front condensation unit of the parallel-connected condensation device according to the second embodiment of the present invention.
Figure 10:
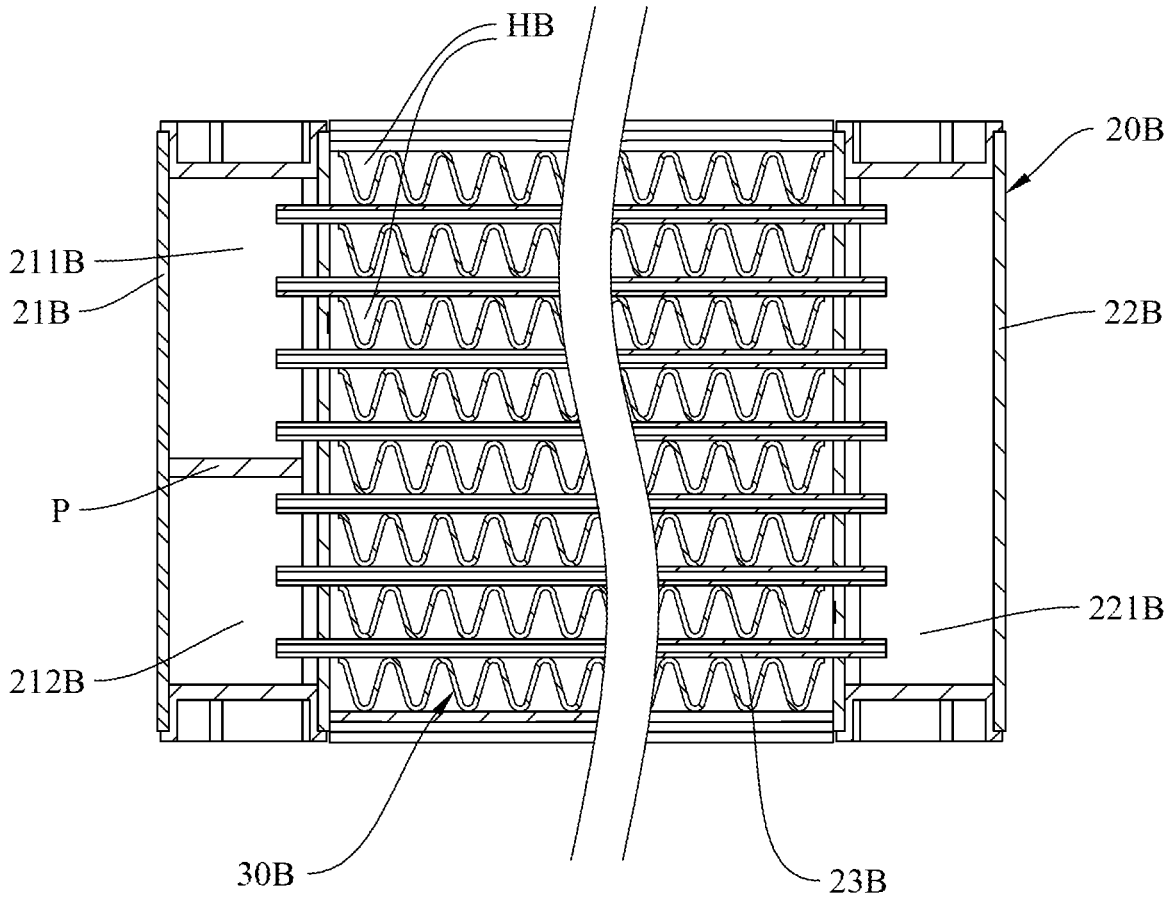
FIG. 10 is a sectional view of the rear condensation unit of the parallel-connected condensation device according to the second embodiment of the present invention.

Please refer to FIG. 9 and FIG. 10 for sectional views respectively of the front condensation unit and the rear condensation unit of the parallel-connected condensation device according to the second embodiment of the present invention.

As shown in FIG. 9, the front condensation unit 10B includes a front left flow tube 11B, a front right flow tube 12B (these two tubes being provided on the two opposite lateral sides of the front condensation unit 10B respectively), and a plurality of front heat dissipation tubes 13B in communication with the front left flow tube 11B and the front right flow tube 12B. The front heat dissipation tubes 13B are vertically spaced apart. The front left flow tube 11B includes a first confluence chamber 111B and a second confluence chamber 112B below the first confluence chamber 111B. The front right flow tube 12B includes a third confluence chamber 121B.

As shown in FIG. 10, the rear condensation unit 20B is parallel to the front condensation unit 10B and includes a rear left flow tube 21B, a rear right flow tube 22B (these two tubes being provided on the two opposite lateral sides of the rear condensation unit 20B respectively), and a plurality of rear heat dissipation tubes 23B in communication with the rear left flow tube 21B and the rear right flow tube 22B. The rear heat dissipation tubes 23B are vertically spaced apart. The gaps between the rear heat dissipation tubes 23B and those between the front heat dissipation tubes 13B correspond to each other and jointly form a plurality of through grooves HB. The rear left flow tube 21B includes a fourth confluence chamber 211B and a fifth confluence chamber 212B below the fourth confluence chamber 211B. The rear right flow tube 22B includes a sixth confluence chamber 221B.

Each of the front left flow tube 11B and the rear left flow tube 21B is provided therein with a partition plate P for separating the confluence chambers in the corresponding flow tube. Each partition plate P is generally at a position about ⅓ to ½ as high as the corresponding flow tube, as shown in FIG. 9 and FIG. 10. It should be pointed out, however, that the partition plates P shown in FIG. 9 and FIG. 10 serve only as an example; the present invention has no limitation on the number or positions of the partition plates P.

At least one upper opening UOB is provided between the front left flow tube 11B and the rear left flow tube 21B to enable communication between the first confluence chamber 111B and the fourth confluence chamber 211B. In addition, at least one lower opening DOB is provided between the front left flow tube 11B and the rear left flow tube 21B to enable communication between the second confluence chamber 112B and the fifth confluence chamber 212B. As shown in FIG. 9, there is one upper opening UOB and one lower opening DOB, and both openings are rectangular. It should be pointed out, however, that the openings shown in FIG. 9 serve only as an example; the present invention imposes no limitation on the number or shape of those openings.

The front left flow tube 11B is provided with a refrigerant inlet 113B in communication with the first confluence chamber 111B so that a refrigerant can be delivered through the refrigerant inlet 113B into the first confluence chamber 111B. The refrigerant inlet 113B overlaps the upper opening UOB by an area less than 45% of the area of the refrigerant inlet 113B. The front left flow tube 11B is further provided with a refrigerant outlet 114B in communication with the second confluence chamber 112B so that the refrigerant in the second confluence chamber 112B can be output through the refrigerant outlet 114B.

Figure 11:
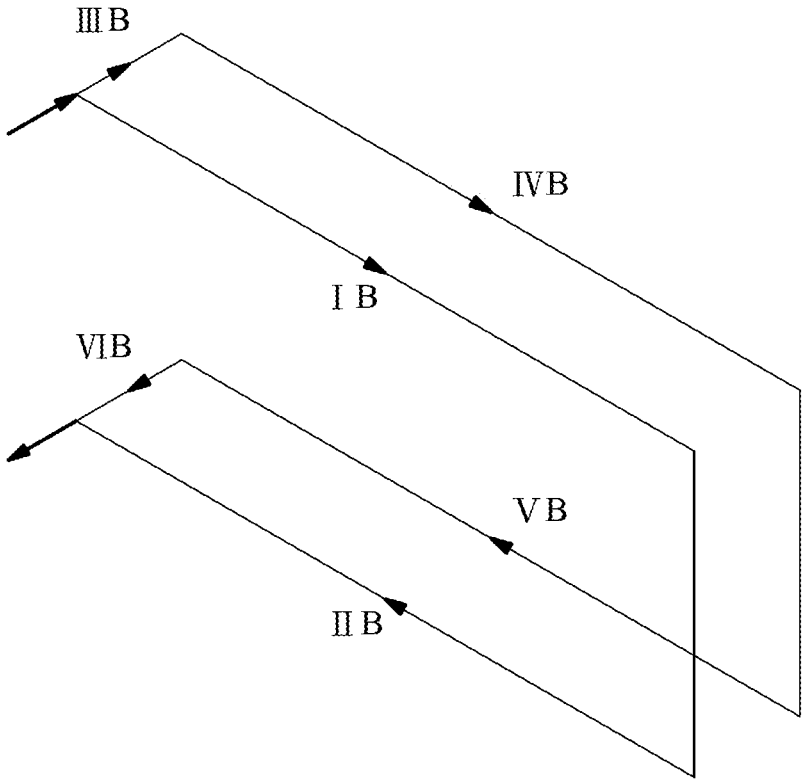
FIG. 11 is the refrigerant circulation diagram of the parallel-connected condensation device according to the second embodiment of the present invention.

Please refer now to FIG. 11 for the refrigerant circulation diagram of the parallel-connected condensation device according to the second embodiment of the present invention.

To begin with, a refrigerant is input through the refrigerant inlet 113B into the first confluence chamber 111B of the front left flow tube 11B. The first confluence chamber 111B communicates with the third confluence chamber 121B of the front right flow tube 12B through the corresponding upper ones of the front heat dissipation tubes 13B to form a first flow channel I B. The third confluence chamber 121B of the front right flow tube 12B communicates with the second confluence chamber 112B of the front left flow tube 11B through the corresponding lower ones of the front heat dissipation tubes 13B to form a second flow channel II B, which lies below the first flow channel I B and has a flow direction opposite to that of the first flow channel I B. The first confluence chamber 111B of the front left flow tube 11B also communicates with the fourth confluence chamber 211B of the rear left flow tube 21B through the upper opening UOB to form a third flow channel III B. The fourth confluence chamber 211B of the rear left flow tube 21B communicates with the sixth confluence chamber 221B of the rear right flow tube 22B through the corresponding upper ones of the rear heat dissipation tubes 23B to form a fourth flow channel IV B, which is connected to the first flow channel I B in parallel and has the same flow direction as the first flow channel I B. The sixth confluence chamber 221B of the rear right flow tube 22B communicates with the fifth confluence chamber 212B of the rear left flow tube 21B through the corresponding lower ones of the rear heat dissipation tubes 23B to form a fifth flow channel V B, which is connected to the second flow channel II B in parallel and has the same flow direction as the second flow channel II B. The fifth confluence chamber 212B of the rear left flow tube 21B communicates with the second confluence chamber 112B of the front left flow tube 11B through the lower opening DOB to form a sixth flow channel VI B, which lies below the third flow channel III B and has a flow direction opposite to that of the third flow channel III B. The refrigerant in the second flow channel II B and the refrigerant in the sixth flow channel VI B eventually come together and exit by the refrigerant outlet 114B.

Disclosed below is the parallel-connected condensation device according to the third embodiment of the present invention. Please refer to FIG. 12 for a perspective view of the parallel-connected condensation device according to the third embodiment of the present invention.

Figure 12:
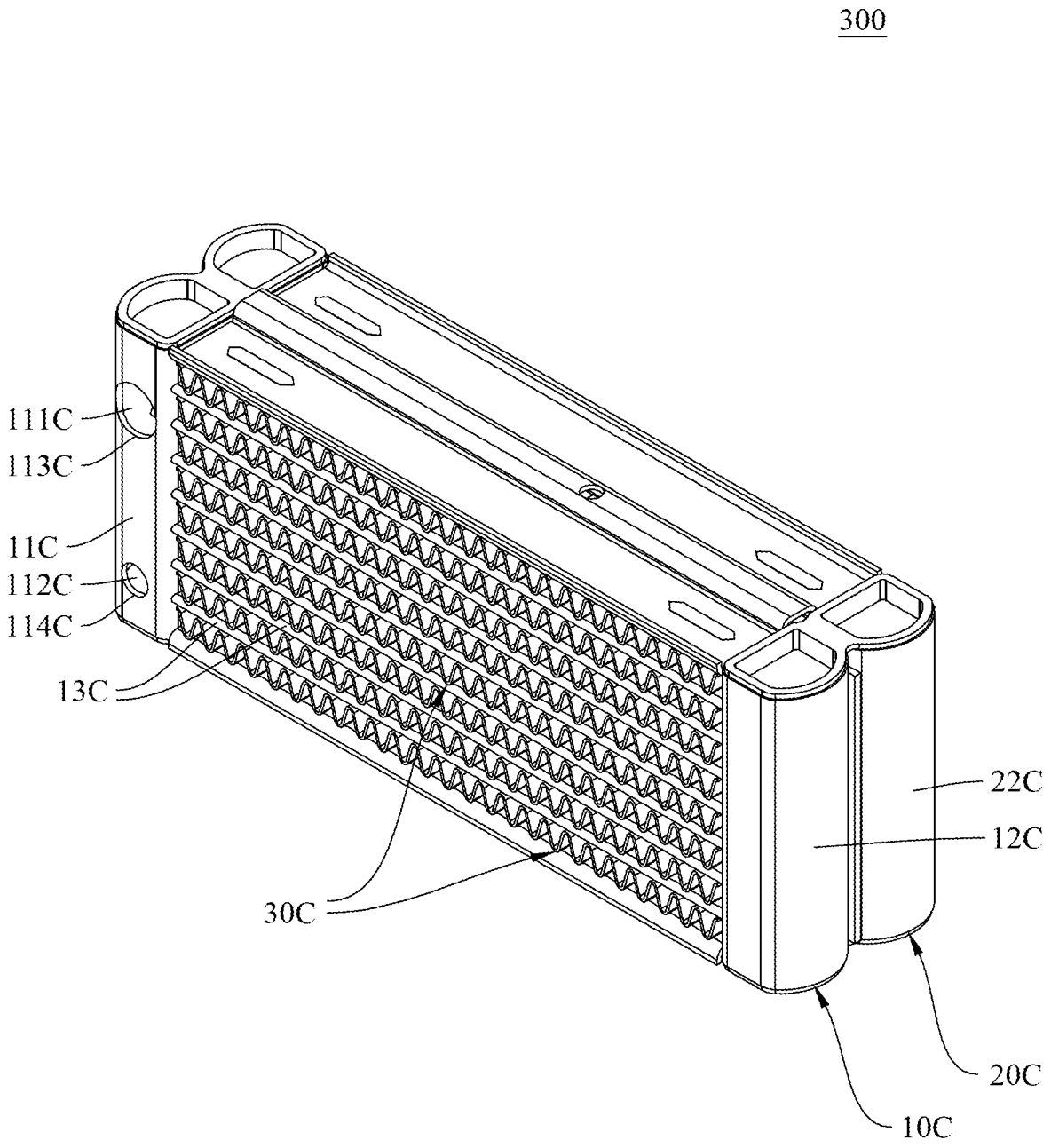
FIG. 12 is a perspective view of the parallel-connected condensation device according to the third embodiment of the present invention.

As shown in FIG. 12, the parallel-connected condensation device 300 includes a front condensation unit 10C, a rear condensation unit 20C, and a plurality of heat dissipation fins 30C, which extend through the front condensation unit 10C and the rear condensation unit 20C to enable heat exchange with both condensation units 10C and 20C. This embodiment is different from the second embodiment mainly in the positions of the partition plates. Meanwhile, the heat dissipation fins, the front heat dissipation tubes, and the rear heat dissipation tubes in this embodiment are the same as those in the second embodiment and therefore will not be described repeatedly.

Figure 13:
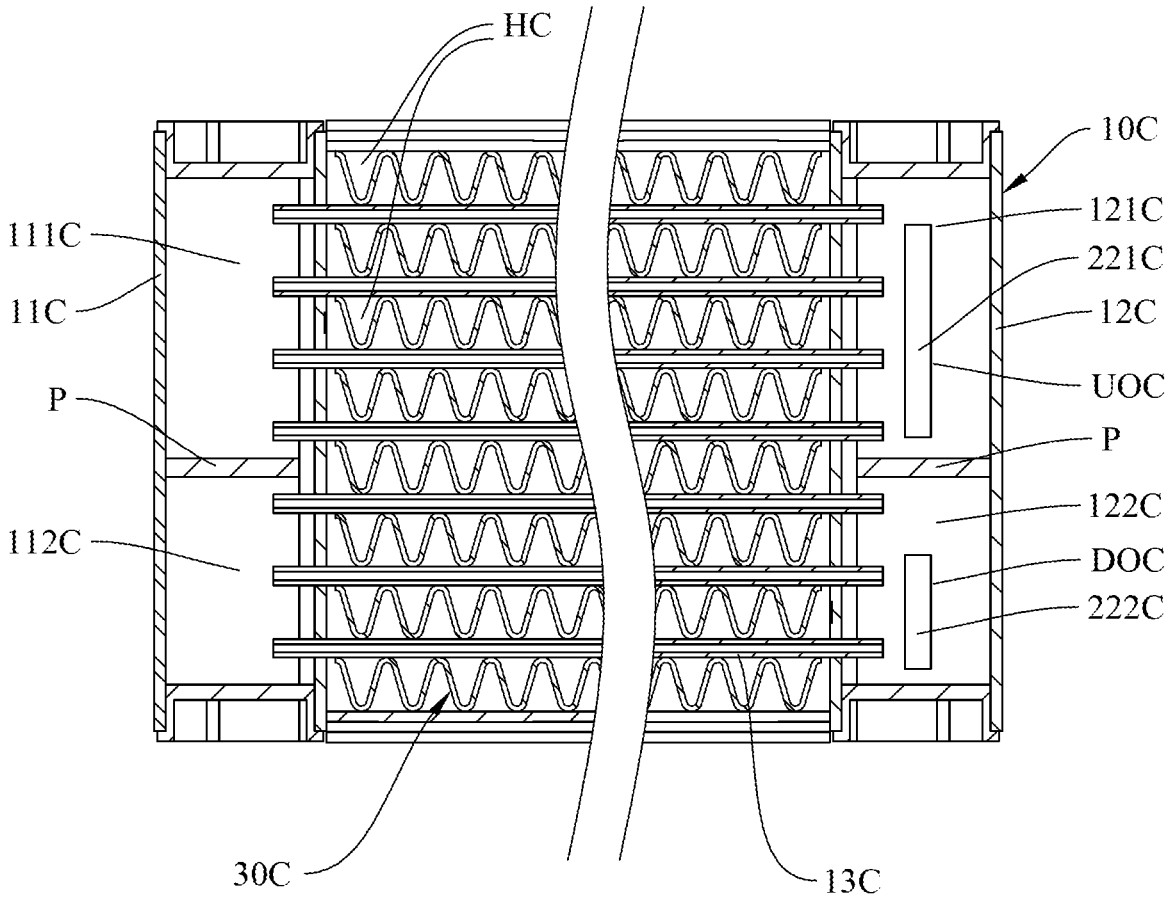
FIG. 13 is a sectional view of the front condensation unit of the parallel-connected condensation device according to the third embodiment of the present invention.
Figure 14:
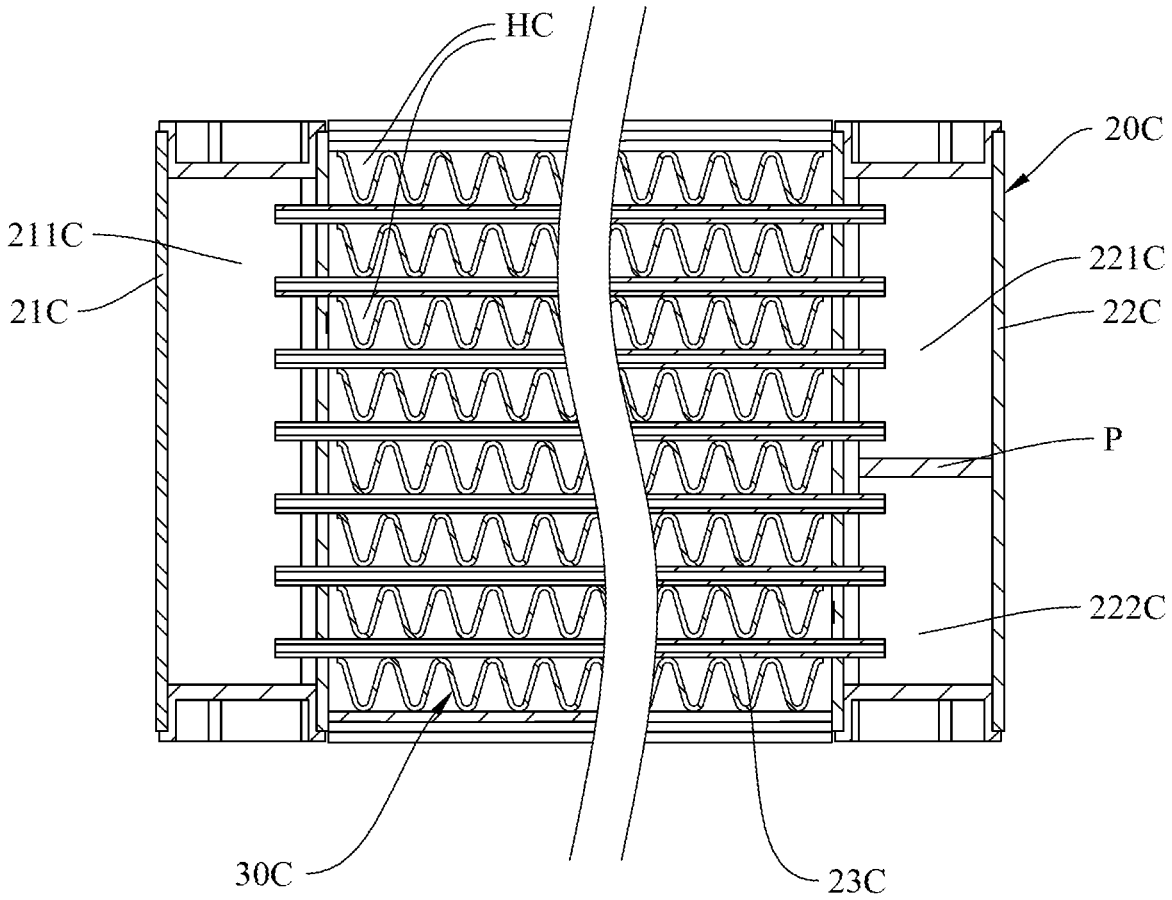
FIG. 14 is a sectional view of the rear condensation unit of the parallel-connected condensation device according to the third embodiment of the present invention.

Please refer to FIG. 13 and FIG. 14 for sectional views respectively of the front condensation unit and the rear condensation unit of the parallel-connected condensation device according to the third embodiment of the present invention.

As shown in FIG. 13, the front condensation unit 10C includes a front left flow tube 11C, a front right flow tube 12C (these two tubes being provided on the two opposite lateral sides of the front condensation unit 10C respectively), and a plurality of front heat dissipation tubes 13C in communication with the front left flow tube 11C and the front right flow tube 12C. The front heat dissipation tubes 13C are vertically spaced apart. The front left flow tube 11C includes a first confluence chamber 111C and a second confluence chamber 112C below the first confluence chamber 111C. The front right flow tube 12C includes a third confluence chamber 121C and a fourth confluence chamber 122C below the third confluence chamber 121C.

As shown in FIG. 14, the rear condensation unit 20C is parallel to the front condensation unit 10C and includes a rear left flow tube 21C, a rear right flow tube 22C (these two tubes being provided on the two opposite lateral sides of the rear condensation unit 20C respectively), and a plurality of rear heat dissipation tubes 23C in communication with the rear left flow tube 21C and the rear right flow tube 22C. The rear heat dissipation tubes 23C are vertically spaced apart. The gaps between the rear heat dissipation tubes 23C and those between the front heat dissipation tubes 13C correspond to each other and jointly form a plurality of through grooves HC. The rear left flow tube 21C includes a fifth confluence chamber 211C. The rear right flow tube 22C includes a sixth confluence chamber 221C and a seventh confluence chamber 222C below the sixth confluence chamber 221C.

Each of the front left flow tube 11C, the front right flow tube 12C, and the rear right flow tube 22C is provided therein with a partition plate P for separating the confluence chambers in the corresponding flow tube. Each partition plate P is generally at a position about ⅓ to ½ as high as the corresponding flow tube, as shown in FIG. 13 and FIG. 14. It should be pointed out, however, that the partition plates P illustrated herein serve only as an example; the present invention has no limitation on the number or positions of the partition plates P.

An upper opening UOC is provided between the front right flow tube 12C and the rear right flow tube 22C to enable communication between the third confluence chamber 121C and the sixth confluence chamber 221C. In addition, a lower opening DOC is provided between the front right flow tube 12C and the rear right flow tube 22C to enable communication between the fourth confluence chamber 122C and the seventh confluence chamber 222C. It should be pointed out that, while FIG. 13 shows one rectangular upper opening UOC and one rectangular lower opening DOC, the openings shown in FIG. 13 serve only as an example; the present invention imposes no limitation on the number or shapes of those openings.

The front left flow tube 11C is provided with a refrigerant inlet 113C in communication with the first confluence chamber 111C so that a refrigerant can be delivered through the refrigerant inlet 113C into the first confluence chamber 111C. The front left flow tube 11C is further provided with a refrigerant outlet 114C in communication with the second confluence chamber 112C so that the refrigerant in the second confluence chamber 112C can be output through the refrigerant outlet 114C.

Figure 15:
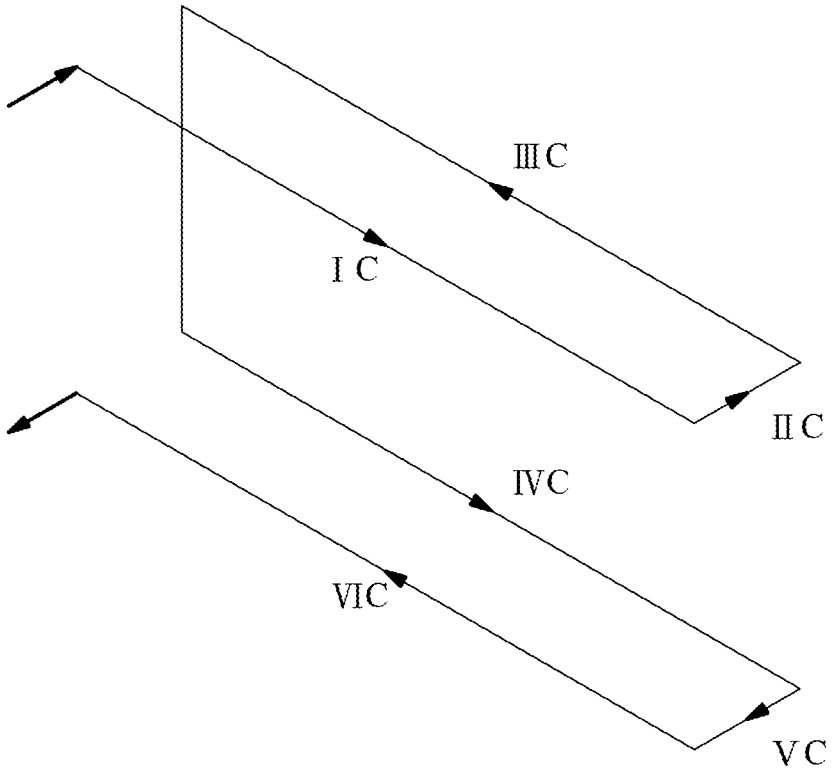
FIG. 15 is the refrigerant circulation diagram of the parallel-connected condensation device according to the third embodiment of the present invention.

Please refer now to FIG. 15 for the refrigerant circulation diagram of the parallel-connected condensation device according to the third embodiment of the present invention.

To begin with, a refrigerant is input through the refrigerant inlet 113C into the first confluence chamber 111C of the front left flow tube 11C. The first confluence chamber 111C communicates with the third confluence chamber 121C of the front right flow tube 12C through the corresponding upper ones of the front heat dissipation tubes 13C to form a first flow channel I C. The third confluence chamber 121C of the front right flow tube 12C communicates with the sixth confluence chamber 221C of the rear right flow tube 22C through the upper opening UOC to form a second flow channel II C. The sixth confluence chamber 221C of the rear right flow tube 22C communicates with the fifth confluence chamber 211C of the rear left flow tube 21C through the corresponding upper ones of the rear heat dissipation tubes 23C to form a third flow channel III C, which is connected to the first flow channel I C in parallel and has a flow direction opposite to that of the first flow channel I C. The fifth confluence chamber 211C of the rear left flow tube 21C communicates with the seventh confluence chamber 222C of the rear right flow tube 22C through the corresponding lower ones of the rear heat dissipation tubes 23C to form a fourth flow channel IV C, which is connected to the first flow channel I C in parallel and has the same flow direction as the first flow channel I C. The seventh confluence chamber 222C of the rear right flow tube 22C communicates with the fourth confluence chamber 122C of the front right flow tube 12C through the lower opening DOC to form a fifth flow channel V C, which lies below the second flow channel II C and has a flow direction opposite to that of the second flow channel II C. The fourth confluence chamber 122C of the front right flow tube 12C communicates with the second confluence chamber 112C of the front left flow tube 11C through the corresponding lower ones of the front heat dissipation tubes 13C to form a sixth flow channel VI C, which is connected to the fourth flow channel IV C in parallel and has a flow direction opposite to that of the fourth flow channel IV C. The refrigerant in the sixth flow channel VI C is output through the refrigerant outlet 114C.

According to the above, the parallel-connected front and rear condensation units in the present invention form a plurality of flow channels that allow the refrigerant flowing there through to absorb as much heat as possible. In addition, the heat dissipation fins extend through the front and rear condensation units to effectively enhance the overall cooling effect.

The above is the detailed description of the present invention. However, the above is merely the preferred embodiment of the present invention and cannot be the limitation to the implement scope of the present invention, which means the variation and modification according to the present invention may still fall into the scope of the invention.

What is claimed is:

1. A parallel-connected condensation device, comprising:

a front condensation unit comprising a front first upright flow tube, a front second upright flow tube, and a plurality of front heat dissipation tubes in communication with the front first upright flow tube and the front second upright flow tube, wherein the front first upright flow tube and the front second upright flow tube are provided on two opposite lateral sides of the front condensation unit respectively, the front heat dissipation tubes are vertically spaced apart, the front first upright flow tube includes a first confluence chamber, and the front second upright flow tube includes a second confluence chamber, wherein the front first upright flow tube is provided with a refrigerant inlet in communication with the first confluence chamber, the front second upright flow tube is provided with a refrigerant outlet in communication with the second confluence chamber;

a rear condensation unit parallel to the front condensation unit and comprising a rear first upright flow tube, a rear second upright flow tube, and a plurality of rear heat dissipation tubes in communication with the rear first upright flow tube and the rear second upright flow tube, wherein the rear first upright flow tube and the rear second upright flow tube are provided on two opposite lateral sides of the rear condensation unit respectively, the rear heat dissipation tubes are vertically spaced apart, gaps between the rear heat dissipation tubes and gaps between the front heat dissipation tubes correspond to each other and jointly form a plurality of through grooves, the rear first upright flow tube includes a third confluence chamber, and the rear second upright flow tube includes a fourth confluence chamber; and a plurality of heat dissipation fins inserted in the through grooves respectively and thereby extending through the front condensation unit and the rear condensation unit, wherein the heat dissipation fins are in contact with surfaces of the front heat dissipation tubes and surfaces of the rear heat dissipation tubes to enable heat exchange between the heat dissipation fins and the heat dissipation tubes;

wherein at least one first opening is sandwiched inbetween the front first upright flow tube and the rear first upright flow tube and align to the refrigerant inlet through the first confluence chamber to enable communication between the first confluence chamber and the third confluence chamber, at least one second opening is sandwiched inbetween the front second upright flow tube and the rear second upright flow tube and align to the refrigerant outlet through the second confluence chamber to enable communication between the second confluence chamber and the fourth confluence chamber, the first confluence chamber of the front first upright flow tube communicates with the second confluence chamber of the front second upright flow tube through the front heat dissipation tubes to form a first flow channel, and the third confluence chamber of the rear first upright flow tube communicates with the fourth confluence chamber of the rear second upright flow tube through the rear heat dissipation tubes to form a second flow channel, the second flow channel being connected in parallel to the first flow channel;

wherein the first opening and the second opening are diagonally arranged with respect to each other, and bottom side of the first opening is higher than top side of the second opening, and an area of the first opening is larger than that of the second opening to speed up the refrigerant input of the first opening, which is faster than the output of the second opening.

2. The parallel-connected condensation device of claim 1, wherein the front heat dissipation tube has a flattened configuration.

3. The parallel-connected condensation device of claim 1, wherein the front heat dissipation tube and the rear heat dissipation tube are respectively provided therein with a plurality of supporting ribs, which extend through the front heat dissipation tube and the rear heat dissipation tube.

4. The parallel-connected condensation device of claim 1, further comprising a plurality of microstructures on the surface of each heat dissipation fin to increase the area of contact between each heat dissipation fin and air.

5. The parallel-connected condensation device of claim 1, wherein the heat dissipation fins have a corrugated configuration or a serrated configuration.

* * * * *